US005969230A

United States Patent [19]

Sakai et al.

[11] Patent Number: 5,969,230

[45] Date of Patent: Oct. 19, 1999

[54] SYSTEM AND METHOD FOR ESTIMATING THE TEMPERATURE OF OXYGEN SENSOR INSTALLED IN EXHAUST SYSTEM OF INTERNAL COMBUSTION ENGINE

[75] Inventors: Shoichi Sakai; Akira Uchikawa, both of Gunma, Japan

[73] Assignee: Unisia Jecs Corporation, Atsugi, Japan

[21] Appl. No.: 08/970,524

[22] Filed: Nov. 14, 1997

[30] Foreign Application Priority Data

Nov. 19, 1996 [JP] Japan ..... 8-307610

[51] Int. Cl.[6] ..... F01N 3/00

[52] U.S. Cl. ..... 73/23.31; 73/118.1; 60/276; 123/697

[58] Field of Search ..... 73/23.31, 23.32, 73/116, 117.2, 117.3, 118.1; 60/276, 274; 123/697

[56] References Cited

U.S. PATENT DOCUMENTS

| | | | |
|---|---|---|---|
| 4,291,572 | 9/1981 | Maurer et al. | 73/23.31 |
| 4,561,402 | 12/1985 | Nakano et al. | 123/489 |
| 5,405,521 | 4/1995 | Nakamori et al. | 204/425 |
| 5,605,040 | 2/1997 | Cullen et al. | 60/274 |
| 5,901,553 | 5/1999 | Cullen | 60/274 |

FOREIGN PATENT DOCUMENTS 7-269401 10/1995 Japan .

*Primary Examiner*—Eric S. McCall
*Attorney, Agent, or Firm*—Foley & Lardner

[57] ABSTRACT

A system for estimating the temperature of an oxygen sensor installed in an exhaust system of an engine comprises a section for sensing a load of the engine; a section for sensing a rotation speed of the engine; and a section which, based on both the engine load and the engine rotation speed, calculates a basic estimated temperature of the oxygen sensor which would appear under a normal condition. A section is employed which senses a speed of the vehicle. A section is employed which, based on the vehicle speed, determines a first correction factor for correcting the basic estimated temperature. A section is employed which senses the temperature of outside air. A section is employed which, based on the outside air temperature, determines a second correction factor for correcting the basic estimated temperature. A target estimated temperature calculating section is employed which, based on the basic estimated temperature and the first and second correction factors, calculates a target estimated temperature of the oxygen sensor and issues an output signal representative of the target estimated temperature. A stopper section is further employed which suppresses the target estimated temperature calculating section from issuing the output signal or calculating the target estimated temperature until a predetermined time passes from a time on which energization of the electric heater starts.

8 Claims, 3 Drawing Sheets

SYSTEM AND METHOD FOR ESTIMATING THE TEMPERATURE OF OXYGEN SENSOR INSTALLED IN EXHAUST SYSTEM OF INTERNAL COMBUSTION ENGINE

BACKGROUND OF THE INVENTION

1. Field of the Invention

The present invention relates in general to systems and methods for controlling operation of an automotive internal combustion engine based on an information signal issued from an oxygen sensor installed in an exhaust system of the engine, and more particularly to systems and methods for estimating the temperature of the oxygen sensor to measure the current activating degree of the oxygen sensor. More specifically, the present invention is concerned with the estimating systems and methods of a type which estimates the temperature of the oxygen sensor based on an operating condition of the engine and a driving condition of an associated motor vehicle.

2. Description of the Prior Art

Hitherto, in motor vehicles powered by an internal combustion engine, there have been widely employed a so-called air/fuel ratio feed-back control system which controls operation of the engine based on an information signal issued from an oxygen sensor installed in an exhaust system of the engine. In fact, as the oxygen concentration in the exhaust gas has a close relation with an air-fuel ratio of the mixture fed to the engine, the control of engine operation is so made as to bring a current air/fuel ratio to a target air/fuel ratio with reference to the information signals issued from the oxygen sensor.

As is known, since the intrinsic function of the oxygen sensor is exhibited only when the sensor (more specifically, oxygen sensing element thereof) is heated up to its activating temperature, the air/fuel ratio feed-back control is started once the sensing element of the oxygen sensor is heated up to such activating temperature.

Hitherto, in the air/fuel ratio feed-back control system, for the need of diagnosing the responsibility of the oxygen sensor, the temperature of the sensing element of the oxygen sensor has been estimated based on the temperature of engine cooling water and the time elapsed from engine start. One conventional technique for estimating the oxygen sensor temperature is described in Japanese Patent First Provisional Publication 7- 269401.

However, due to inherent construction, the above-mentioned conventional temperature estimating technique tends to produce a non-negligible error in estimating the temperature of the oxygen sensing element under a certain operating condition of the engine and a certain environment. Such error causes the air/fuel ratio feed-back control system to fail to exhibit its intrinsic function. That is, such error obstructs the control system from not only feeding the engine with a mixture of a desired air/fuel ratio but also carrying out a proper diagnosis on the responsibility of the oxygen sensor.

SUMMARY OF THE INVENTION

It is therefore an object of the present invention to provide a system for estimating the temperature of a sensing element of an oxygen sensor, which is free of the above-mentioned drawbacks.

According to a first aspect of the present invention, there is provided a system in a motor vehicle having an internal combustion engine mounted thereon, the engine being controlled by an air/fuel ratio feed-back control system wherein an oxygen sensor is used for sensing an oxygen concentration in an exhaust system of the engine, the oxygen sensor having an electric heater mounted thereon. The system estimates the temperature of the oxygen sensor installed in the exhaust system of the engine, and comprises first means for sensing a load of the engine; second means for sensing a rotation speed of the engine; third means which, based on both the sensed engine load and the sensed engine rotation speed, calculates a basic estimated temperature of the oxygen sensor which would appear under a normal condition; fourth means for sensing a speed of the vehicle; fifth means which, based on the sensed vehicle speed, determines a first correction factor for correcting the basic estimated temperature; sixth means for sensing the temperature of outside air; seventh means which, based on the sensed outside air temperature, determines a second correction factor for correcting the basic estimated temperature; eighth means which, based on the basic estimated temperature and the first and second correction factors, calculates a target estimated temperature of the oxygen sensor and issues an output signal representative of the target estimated temperature; and ninth means for suppressing the eighth means from issuing the output signal until a predetermined time passes from a time on which energization of the electric heater starts.

According to a second aspect of the present invention, there is provided a system in a motor vehicle having an internal combustion engine mounted thereon, the engine being controlled by an air/fuel ratio feed-back control system wherein an oxygen sensor is used for sensing an oxygen concentration in an exhaust system of the engine, the oxygen sensor having an electric heater mounted thereon. The system estimates the temperature of the oxygen sensor installed in the exhaust system of the engine, and comprises first means for sensing a load of the engine; second means for sensing a rotation speed of the engine; third means which, based on both the sensed engine load and the sensed engine rotation speed, calculates a basic estimated temperature of the oxygen sensor appearing under a normal condition; fourth means for sensing a speed of the vehicle; fifth means which, based on the sensed vehicle speed, determines a first correction factor for correcting the basic estimated temperature; sixth means for sensing the temperature of outside air; seventh means which, based on the sensed outside air temperature, determines a second correction factor for correcting the basic estimated temperature; eighth means which, based on the basic estimated temperature and the first and second correction factors, calculates a target estimated temperature of the oxygen sensor and issues an output signal representative of the target estimated temperature; and ninth means for suppressing the eighth means from calculating the target estimated temperature until a predetermined time passes from a time on which energization of the electric heater starts.

BRIEF DESCRIPTION OF THE DRAWINGS

Other objects of the present invention will become apparent from the following description when taken in conjunction with the accompanying drawings, in which.

DETAILED DESCRIPTION OF THE INVENTION

Figure 1:
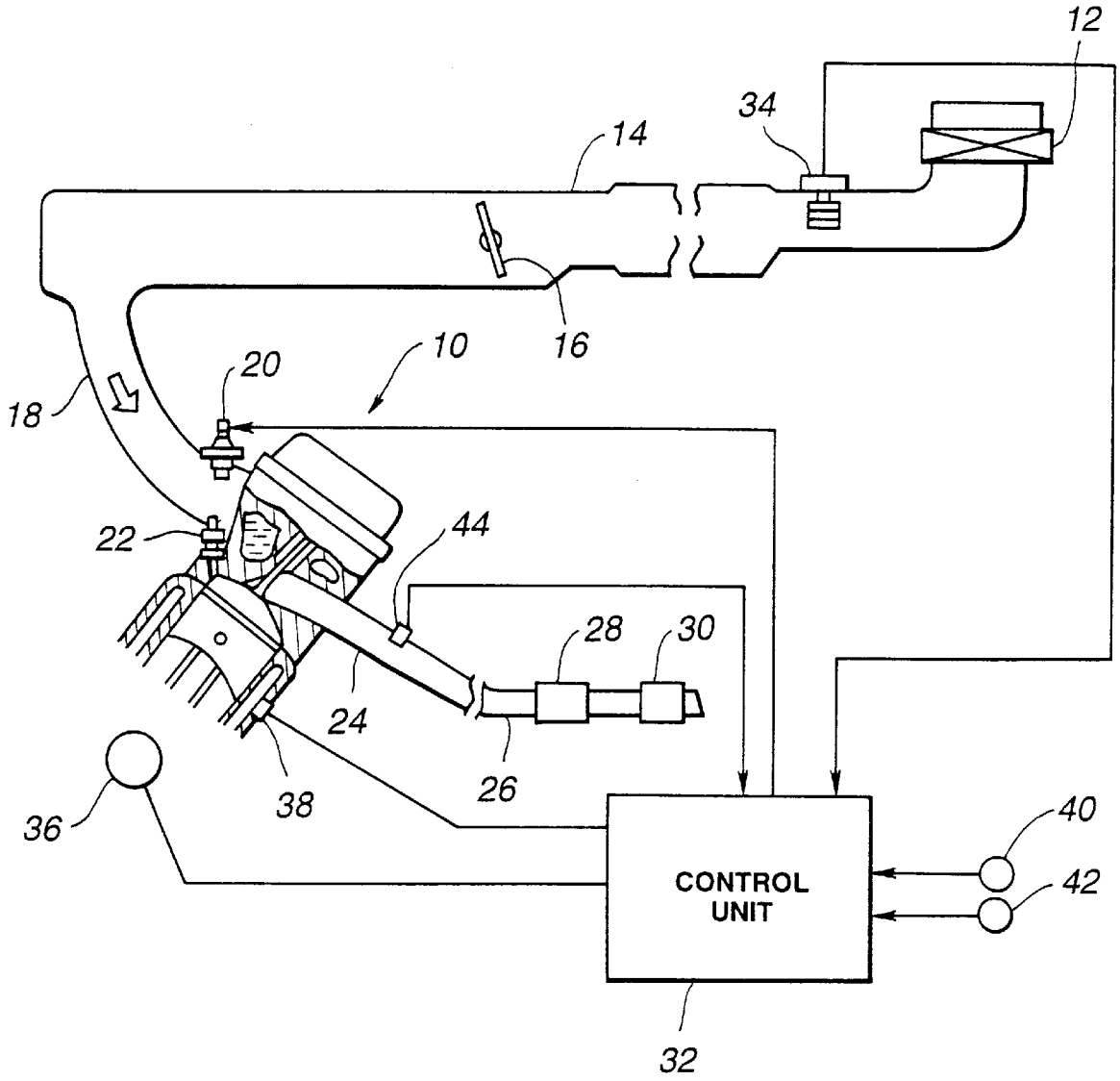
FIG. 1 is a schematic view of an internal combustion engine to which a system of the present invention is practically applied.

Referring to FIG. 1, there is schematically shown an internal combustion engine 10 to which a system of the present invention is practically applied. Although not shown in the drawing, the engine 10 is mounted on a vehicle body. The engine 10 is equipped with intake and exhaust systems.

The intake system generally comprises an air cleaner 12, an air duct 14, a throttle valve 16 and an intake manifold 18 which are arranged in the illustrated conventional manner. That is, cleaned air from the air cleaner 12 is fed to the engine 10 through the air duct 14, the throttle valve 16 and the intake manifold 18. Branches of the intake manifold 18 are equipped with fuel injection valves 20 for respective cylinders of the engine 10. The fuel injection valves 20 are of an electromagnetic type which opens when energized and closes when de-energized. As will be described in detail hereinafter, upon receiving an injection instruction pulse signal (viz., pulse duty ratio signal) from a control unit 32, each fuel injection valve 20 is controlled to inject a certain amount of pressurized fuel into the corresponding branch of the intake manifold 18. The pressurized fuel is supplied from a fuel pump (not shown) powered by the engine and is regulated in pressure by a pressure regulator (not shown) to have a predetermined pressure before being led to the fuel injection valve 20.

It is to be noted that the fuel injection valve 20 may be of a type which can directly inject fuel into a combustion chamber of the engine 10.

As shown, each combustion chamber of the engine 10 is equipped with a spark plug 22 for igniting an air/fuel mixture led into the combustion chamber.

The exhaust system of the engine 10 generally comprises an exhaust manifold 24, an exhaust duct 26, a catalytic converter 28 and a muffler 30. That is, exhaust gas produced by the engine 10 is discharged to the open air through the exhaust manifold 24, the exhaust duct 26, the catalytic converter 28 and the muffler 30.

Designated by numeral 32 is a control unit having a microcomputer which, as is known, comprises CPU, RAM, ROM, A/D converter, and input and output interface. Based on information signals issued from various sensors, the computer calculates a desired amount of fuel "Ti" to be injected by each fuel injection valve 20, and based on the calculated desired amount of fuel "Ti", the computer controls each fuel injection valve 20 to inject the desired amount of fuel to the corresponding combustion chamber. That is, for this fuel injection control, a solenoid of each fuel injection valve 20 receives a voltage signal from the computer. The voltage signal is a pulse-width signal, meaning that the longer the pulse width, then the longer the fuel injection valve 20 remains open.

The sensors are, for example, an air-flow meter 34 which outputs a signal corresponding the amount of intake air "Q" led to the engine 10, a crank angle sensor 36 which outputs a signal corresponding rotation speed "Ne" of the engine 10, a water temperature sensor 38 which outputs a signal corresponding to the temperature "Tw" of an engine cooling water, a vehicle speed sensor 40 which outputs a signal corresponding to a running speed "VSP" of the vehicle on which the engine 10 is mounted, an outside air temperature sensor 42 which outputs a signal corresponding to the outside air temperature "Ta".

An oxygen sensor 44 is mounted in a united downstream portion of branches of the exhaust manifold 24, which is positioned upstream of the catalytic converter 28 installed in the exhaust manifold 24. The oxygen sensor 44 is of a conventional type whose output varies in accordance with the oxygen concentration in exhaust gas, which concentration has a close relation with an air-fuel ratio of a mixture fed to the engine.

The oxygen sensor 44 is equipped with an electric heater for heating a sensing element thereof.

Based on both the intake air amount "Q" and the engine speed "Ne", the computer calculates a basic amount "Tp" of injected fuel. When a predetermined condition for a feed-back control is kept established, the computer determines an air-fuel ratio feedback correction factor "$\alpha$" for correcting the basic fuel injection amount "Tp" in such a manner as to bring the output from the oxygen sensor 44 to a value corresponding to a target air/fuel ratio of the mixture. That is, in practice, the basic fuel injection amount "Tp" is corrected with respect to the correction factor "$\alpha$" to finally calculate a desired amount "Ti" of fuel which is to be led into a combustion chamber from a corresponding fuel injection valve 20.

In the present invention, the predetermined condition for the feed-back control includes a condition wherein the oxygen sensor 44 is in its activating condition. In the present invention, the temperature of the sensing element of the oxygen sensor 44 is estimated by the control unit 32 in the following manner. That is, the activating condition of the oxygen sensor 44 is checked by determining whether the estimated temperature of the oxygen sensing element is higher than an activating temperature or not.

Figure 2:
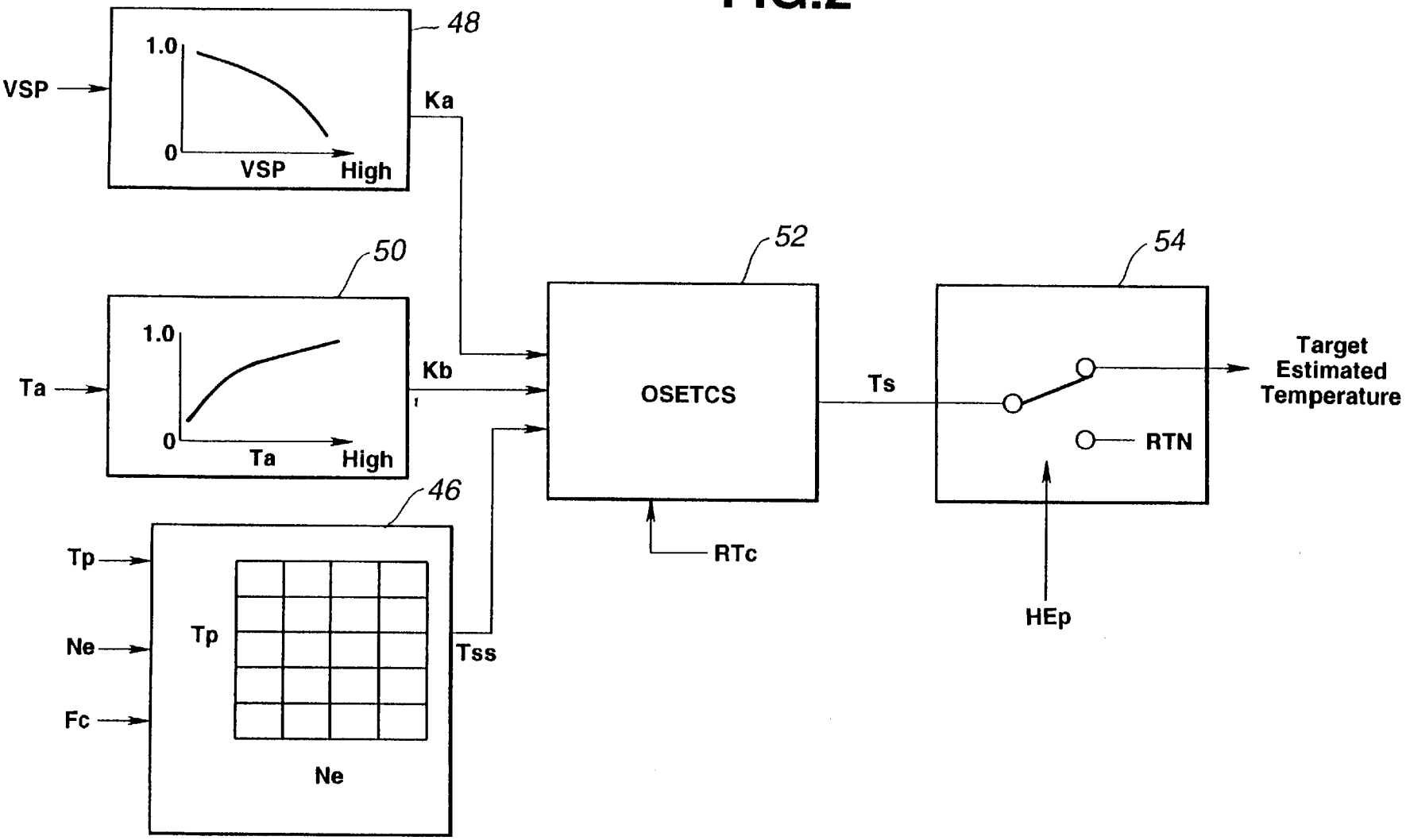
FIG. 2 is a block diagram depicting the temperature estimating process carried out by the system of the present invention.

FIG. 2 shows a process for estimating the temperature of the oxygen sensor 44 carried out by the control unit 32.

In FIG. 2, denoted by numeral 46 is a normal temperature calculating section which, based on both the basic fuel injection amount "Tp" and the engine speed "Ne" which represent the load of the engine 10, computes or calculates a basic temperature "Tss" of the oxygen sensing element under a normal condition. Because of usage of the basic fuel injection amount "Tp" as means for representing the engine load, the air-flow meter 34 and the crank angle sensor 36 constitute an engine load detecting means.

In the normal temperature calculating section 46, a plurality of experimentally provided data maps are memorized, each showing the temperature of the oxygen sensing element for each engine driving condition represented by both the basic fuel injection amount "Tp" and the engine speed "Ne" under a normal condition. That is, by looking up a data map which carries the basic fuel injection amount "Tp" and the engine speed "Ne" at a certain time, the temperature "Tss" of the sensing element of the oxygen sensor 44 is found at the certain time.

When, under deceleration of an associated motor vehicle, fuel supply is enforcedly stopped (which will be referred to as "fuel cut" hereinafter), the temperature of the exhaust gas becomes lower than the temperature exhibited when the fuel supply is normally carried out. Thus, in such a case, the basic estimated temperature "Tss" of the oxygen sensing element has an error inevitably.

Thus, if desired, a fuel-cut representing signal "Fc" may be fed to the normal temperature calculating section 46 for avoiding such error. In this case, other data maps for such fuel-cut condition are also memorized. Of course, each data map shows the temperature of the oxygen sensing element for each driving condition presented by both the basic fuel injection amount "Tp" and the engine speed "Ne" under the fuel cut condition. However, the basic estimated temperature "Tss" of the oxygen sensing element may have a fixed value irrespective of possible various engine driving conditions in a case wherein such fuel-cut is intended for only the deceleration. Furthermore, if desired, the estimated temperature of the oxygen sensing element may be varies in accordance with the number of cylinders to which the fuel cut is practically applied.

Designated by numeral 48 in FIG. 2 is a vehicle speed based correction factor determining section which, based on the vehicle speed "VSP" detected by the vehicle speed sensor 40, determines a correction factor "Ka" for correcting the basic estimated temperature "Tss" of the oxygen sensing element. As shown, the correction factor "ka" reduces as the vehicle speed "VSP" increases, which means that under high speed cruising wherein heat radiation is effectively carried out, the basic estimated temperature "Tss" of the oxygen sensing element is corrected to a much reduced value.

Designated by numeral 50 in FIG. 2 is an outside temperature based correction factor determining section which, based on the outside air temperature "Ta" detected by the outside air temperature sensor 42, determines a correction factor "Kb" for correcting the basic estimated temperature "Tss" of the oxygen sensing element. As shown, the correction factor "Kb" reduces as the outside air temperature "Ta" reduces, which means that in a lower temperature outside condition wherein heat radiation is effectively carried out, the basic estimated temperature "Tss" of the oxygen sensing element is corrected to a much reduced value.

Designated by numeral 52 is an oxygen sensing element temperature calculating section "OSETCS" which, based on the basic estimated temperature "Tss" of the oxygen sensing element, the two correction factors "Ka" and "Kb" and a predetermined responsibility time constant "RTc", calculates a target estimated temperature "Ts" of the oxygen sensing element.

The responsibility time constant "RTc" is previously determined based on a delay on temperature change of the oxygen sensing element with respect to the change of the engine driving condition, the vehicle speed and the outside air temperature.

Designated by numeral 54 in FIG. 2 is an output stopping section to which a signal representing the target estimated temperature "Ts" is fed from the oxygen sensing element temperature calculating section 52. That is, through the output stopping section 54, the calculated result "Ts" at the section 52 is selectively outputted. To the output stopping section 54, there is fed a signal "HEp" representing the time elapsed from the time on which energization of the electric heater of the oxygen sensor 44 has started upon starting of the engine. That is, until the time when the sensing element of the oxygen sensor 44 is estimated to be heated up to a saturated level, the calculated result "Ts" at the section 52 is not outputted. In other words, once such time passes, the calculated result "Ts" is outputted for practically carrying out the judgment of the activating value of the oxygen sensor 44.

Figure 3:
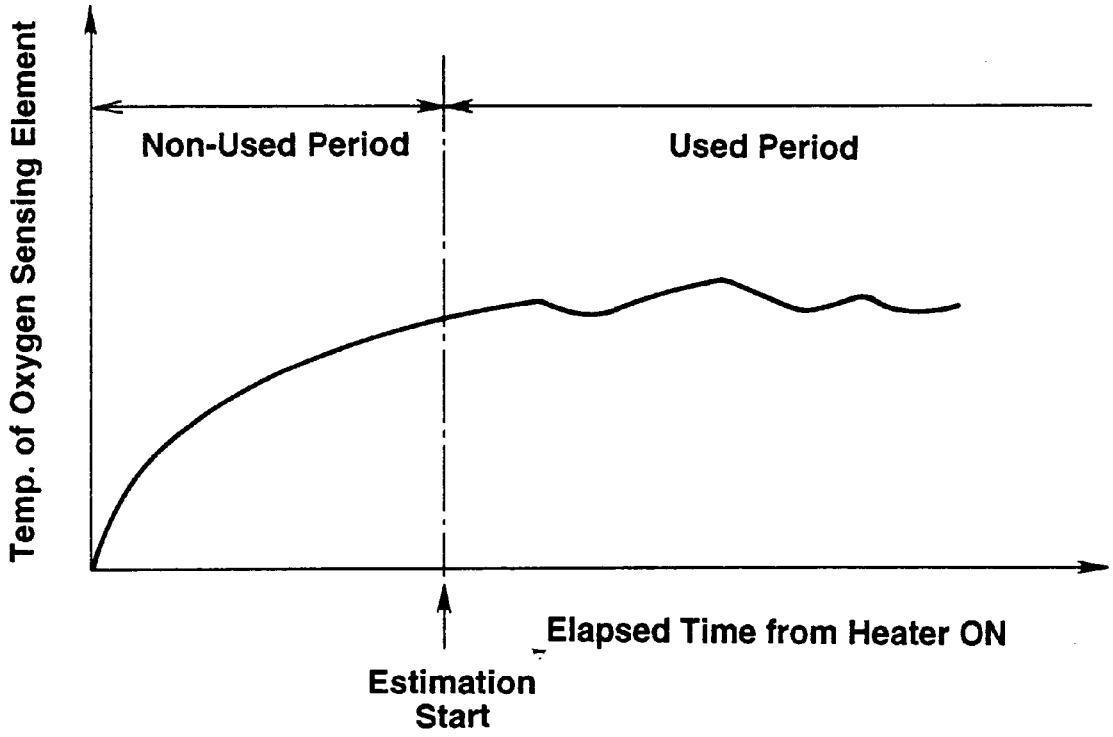
FIG. 3 is a time-chart showing a non-used period for which output from a target temperature calculating section is not used.

As is understood from the graph of FIG. 3, with the output stopping section 54, undesired phenomenon wherein erroneous result is outputted at the time when the temperature of the oxygen sensing element is increasing just after inergization of the heater is suppressed.

The time needed for temperature saturation of the sensing element of the oxygen sensor 44 varies in accordance with the engine driving condition and the outside air temperature. Accordingly, if desired, the time on which outputting of the calculated result representing signal "Ts" is stopped may be varied in accordance the engine driving condition and the outside air temperature. Furthermore, if desired, in place of stopping outputting of the calculated result "Ts", operation of the oxygen sensing element temperature calculating section 52 may be stopped.

What is claimed is:

1. In a motor vehicle having an internal combustion engine mounted thereon, said engine being controlled by an air/fuel ratio feed-back control system wherein an oxygen sensor is used for sensing an oxygen concentration in an exhaust system of the engine, said oxygen sensor having an electric heater mounted thereon, a system for estimating the temperature of the oxygen sensor installed in the exhaust system of the engine, comprising:

first means for sensing a load of the engine;

second means for sensing a rotation speed of the engine;

third means which, based on both the sensed engine load and the sensed engine rotation speed, calculates a basic estimated temperature of the oxygen sensor which would appear under a normal condition;

fourth means for sensing a speed of the vehicle;

fifth means which, based on the sensed vehicle speed, determines a first correction factor for correcting said basic estimated temperature;

sixth means for sensing the temperature of outside air;

seventh means which, based on the sensed outside air temperature, determines a second correction factor for correcting said basic estimated temperature;

eighth means which, based on said basic estimated temperature and said first and second correction factors, calculates a target estimated temperature of the oxygen sensor and issues an output signal representative of said target estimated temperature; and ninth means for suppressing said eighth means from issuing said output signal until a predetermined time passes from a time on which energization of the electric heater starts.

2. A system as claimed in claim 1, in which said eighth means calculates said target estimated temperature with respect to a predetermined responsibility time constant.

3. A system as claimed in claim 1, further comprising tenth means which outputs a predetermined temperature representing signal to said eighth means as a substitute for the basic estimated temperature representing signal when feeding of fuel to said engine is enforcedly stopped under a predetermined driving condition.

4. In a motor vehicle having an internal combustion engine mounted thereon, said engine being controlled by an air/fuel ratio feed-back control system wherein an oxygen sensor is used for sensing an oxygen concentration in an exhaust system of the engine, said oxygen sensor having an electric heater mounted thereon, a system for estimating the temperature of the oxygen sensor installed in the exhaust system of the engine, comprising:

first means for sensing a load of the engine;

second means for sensing a rotation speed of the engine;

third means which, based on both the sensed engine load and the sensed engine rotation speed, calculates a basic estimated temperature of the oxygen sensor appearing under a normal condition;

fourth means for sensing a speed of the vehicle;

fifth means which, based on the sensed vehicle speed, determines a first correction factor for correcting said basic estimated temperature;

sixth means for sensing the temperature of outside air;

seventh means which, based on the sensed outside air temperature, determines a second correction factor for correcting said basic estimated temperature;

eighth means which, based on said basic estimated temperature and said first and second correction factors, calculates a target estimated temperature of the oxygen sensor and issues an output signal representative of said target estimated temperature; and ninth means for suppressing said eighth means from calculating said target estimated temperature until a predetermined time passes from a time on which energization of the electric heater starts.

5. A system as claimed in claim 4, in which said eighth means calculates said target estimated temperature with respect to a predetermined responsibility time constant.

6. A system as claimed in claim 4, further comprising tenth means which outputs a predetermined temperature representing signal to said eighth means as a substitute for the basic estimated temperature representing signal when feeding of fuel to said engine is enforcedly stopped under a predetermined driving condition.

7. In a motor vehicle having an internal combustion engine mounted thereon, said engine being controlled by an air/fuel ratio feed-back control system wherein an oxygen sensor is used for sensing an oxygen concentration in an exhaust system of the engine, said oxygen sensor having an electric heater mounted thereon, a method for estimating the temperature of the oxygen sensor installed in the exhaust system of the engine, comprising the steps of:

sensing a load of the engine;

sensing a rotation speed of the engine;

calculating, based on both the sensed engine load and the sensed engine rotation speed, a basic estimated temperature of the oxygen sensor which would appear under a normal condition;

sensing a speed of the vehicle;

determining, based on the sensed vehicle speed, a first correction factor for correcting said basic estimated temperature;

sensing the temperature of outside air;

determining, based on the sensed outside air temperature, a second correction factor for correcting said basic estimated temperature;

calculating, based on said basic estimated temperature and said first and second correction factors, a target estimated temperature of the oxygen sensor and issuing an output signal representative of said target estimated temperature; and suppressing issuance of said output signal until a predetermined time passes from a time on which energization of the electric heater starts.

8. In a motor vehicle having an internal combustion engine mounted thereon, said engine being controlled by an air/fuel ratio feed-back control system wherein an oxygen sensor is used for sensing an oxygen concentration in an exhaust system of the engine, said oxygen sensor having an electric heater mounted thereon, a method for estimating the temperature of the oxygen sensor installed in the exhaust system of the engine, comprising the steps of:

sensing a load of the engine;

sensing a rotation speed of the engine;

calculating, based on both the sensed engine load and the sensed engine rotation speed, a basic estimated temperature of the oxygen sensor which would appear under a normal condition;

sensing a speed of the vehicle;

determining, based on the sensed vehicle speed, a first correction factor for correcting said basic estimated temperature;

sensing the temperature of outside air;

determining, based on the sensed outside air temperature, a second correction factor for correcting said basic estimated temperature;

calculating, based on said basic estimated temperature and said first and second correction factors, a target estimated temperature of the oxygen sensor and issuing an output signal representative of said target estimated temperature; and suppressing calculation of said target estimated temperature until a predetermined time passes from a time on which energization of the electric heater starts.

* * * * *